US009260208B2

(12) United States Patent
Muehlschlegel et al.

(10) Patent No.: US 9,260,208 B2
(45) Date of Patent: Feb. 16, 2016

(54) PACKAGING MACHINE WITH A LIFTABLE AND LOWERABLE TOOL

(75) Inventors: Johannes Muehlschlegel, Aitrach (DE); Juergen Praesenz, Markt Rettenbach (DE)

(73) Assignee: MULTIVAC SEPP HAGGENMUELLER GMBH & CO. KG, Wolfertschwenden (DE)

( * ) Notice: Subject to any disclaimer, the term of this patent is extended or adjusted under 35 U.S.C. 154(b) by 945 days.

(21) Appl. No.: 13/336,452

(22) Filed: Dec. 23, 2011

(65) Prior Publication Data

US 2012/0159898 A1 Jun. 28, 2012

(30) Foreign Application Priority Data

Dec. 27, 2010 (DE) ..... 10 2010 056 319

(51) Int. Cl.

| | |
|---|---|
| ***B65B 59/00*** | (2006.01) |
| ***B65B 7/16*** | (2006.01) |
| ***B65B 31/02*** | (2006.01) |
| ***B65B 59/04*** | (2006.01) |

(52) U.S. Cl.

CPC ..... *B65B 7/164* (2013.01); *B65B 31/028* (2013.01); *B65B 59/04* (2013.01)

(58) Field of Classification Search

CPC ..... B65B 51/14; B65B 59/00; B65B 59/04; B65B 31/028; B65B 7/164; B65B 65/18; B23B 31/30; B29C 65/02; B29C 65/745; B29C 65/7461; B29C 65/7841; B29C 66/53461; B29C 66/8167; B29C 66/8223; B29C 66/82423; B29C 66/92445; B29C 33/30; F16H 21/22

USPC ..... 53/133.8, 201, 285, 329.2–329.5, 393, 53/396, 453, 454, 559; 425/575, 186, 185, 425/190, 195, 191; 29/401.1; 483/27; 74/89.23, 89.33, 89.34; 248/655, 683; 100/100

See application file for complete search history.

(56) References Cited

U.S. PATENT DOCUMENTS

| | | | | |
|---|---|---|---|---|
| 2,052,927 | A * | 9/1936 | Hallwood | 99/327 |
| 2,252,951 | A * | 8/1941 | Urschel et al. | 99/642 |
| 5,040,965 | A * | 8/1991 | Baird | 425/186 |
| 7,340,871 | B1 * | 3/2008 | Shackelford et al. | 53/453 |
| 2005/0230873 | A1 * | 10/2005 | Schlosser et al. | 264/153 |

FOREIGN PATENT DOCUMENTS

| | | | |
|---|---|---|---|
| DE | 8702495 | U1 | 10/1987 |
| DE | 10 2008 032 306 | A1 | 1/2010 |
| DE | 102008032306 | A1 | 1/2010 |
| JP | 2003104305 | A | 4/2003 |

* cited by examiner

*Primary Examiner* — Thanh Truong
*Assistant Examiner* — Xavier A Madison
(74) *Attorney, Agent, or Firm* — Husch Blackwell LLP

(57) ABSTRACT

The disclosure relates to a packaging machine comprising a liftable and lowerable tool, wherein a first lift drive, implemented as a spindle drive with a spindle and a spindle nut, and a second lift drive are provided for moving the tool in a vertical direction. The disclosure is characterized in that, by means of the second lift drive, a tool guide is movable in a vertical direction, and that, at a raised position of the tool guide, the tool can be put down on the tool guide by means of the spindle drive.

7 Claims, 12 Drawing Sheets

PACKAGING MACHINE WITH A LIFTABLE AND LOWERABLE TOOL

CROSS-REFERENCE TO RELATED APPLICATIONS

This application claims foreign priority benefits under 35 U.S.C. §119(a)-(d) to German patent application number DE 10 2010 056 319.6, filed Dec. 27, 2010 which is incorporated by reference in its entirety.

TECHNICAL FIELD

The disclosure relates to a packaging machine with a liftable and lowerable tool.

BACKGROUND

Such a packaging machine is described e.g., in DE 10 2008 032 306 A1. More specifically, this packaging machine is a tray sealer for use in comparatively small shops or catering establishments, in which trays have to be closed occasionally and individually. In order to allow a more flexible use of such packaging machines, DE 10 2008 032 306 A1 already discloses a possibility of changing the sealing and cutting tools. To this end, a spindle drive used for vertically moving the tool is moved so far that the spindle is brought out of engagement with the spindle nut. The whole tool assembly can now be tilted forwards until it strikes against a stop. When a cover panel of the packaging machine is opened, the whole tool assembly can be removed and replaced by another tool assembly.

This conventional packaging machine is disadvantageous insofar as a certain amount of skill on the part of the operator is still necessary for carrying out the exchange of tools as smoothly as possible.

SUMMARY

It is the object of the present disclosure to improve the packaging machine such that tools can be exchanged by the operator even more easily.

The disclosure is characterized in that, by means of the second lift drive, a tool guide is movable in a vertical direction, and that, at a raised position of the tool guide, the tool can be put down on the tool guide by means of the spindle drive. This tool guide is provided for guiding the movement of the tool during tool exchange. In this way, the tool travels a defined distance, and this already results in a substantial improvement in the tool exchange operation. In addition, the tool guide can be implemented for taking up the weight of the tool during tool exchange. This has the enormous advantage that, during removal of the tool, the operator of the packaging machine need not immediately carry the whole weight of the tool. The possibility of lifting and lowering the tool offers additional advantages: it ensures that the tool guide can move towards the tool when a tool exchange is to be carried out. This leads to a reduction or even an elimination of the distance which the tool has to cover, after decoupling of the spindle drive, when it is being put down on the tool guide. According to a slightly less convenient embodiment it would, however, also be possible that the tool guide cannot be moved in a vertical direction, but maintains a defined position at least in the vertical direction. Within the scope of the present disclosure, also a tilting of the tool guide, in the case of which at least a portion of the tool guide is moved in the vertical direction, is interpreted as a movement of the tool guide in the vertical direction.

The second lift drive can be a drive with a vacuum chamber between a fixed plate and a movable plate (the so-called pressure plate). Such a lift drive has already been described in DE 10 2008 032 306 A1. It is used for causing, after the lowering of the tool by means of the spindle drive, a second lowering movement of the tool so that a very high pressure can be applied to the workpiece (i.e. the package to be produced) by means of the tool for the purpose of cutting or sealing. The present disclosure offers particular advantages when this second lift drive is used not only for producing the sealing or cutting pressure, but when the same drive is also used for lifting and lowering the tool guide for the purpose of tool exchange. In this way, two drives suffice for causing three different movements, viz. a first lifting movement over a large distance by means of the spindle drive, a second (lifting or) lowering movement over a small distance (but with high forces) by means of the second lift drive as well as a lifting or lowering movement of the tool guide, which is also caused by the second lift drive.

It will be expedient when the tool guide is configured for guiding the tool in a substantially horizontal direction. "In a substantially horizontal direction" means in this context that, in certain sections thereof, the tool guide may also be slightly inclined relative to the horizontal, e.g., up to an angle of 20°. Guiding the tool in a substantially horizontal direction has the advantage that the tool guide is able to carry the tool throughout the entire duration of guidance, since the tool is not, or only to a minor extent accelerated by the weight along the tool guide.

Preferably, the tool guide is, when occupying its raised position, arranged such that the tool can be put down directly on the tool guide by extending the spindle drive to the greatest possible extent. In other words, the tool guide is disposed at so high a level that the tool is put down on the tool guide simultaneously with the separation of the spindle from the spindle nut or immediately after said separation. It is thus not necessary that, after the separation of the spindle from the spindle nut, the tool has to "drop" a certain distance before it comes into contact with the tool guide. Preventing such dropping has the advantage that the tool exchange is carried out more gently, and that canting of the tool as well as excessively strong loads on the tool guide are avoided.

When the spindle and the spindle nut of the spindle drive are separated from one another when the tool is being put down on the tool guide, this has the advantage that, after such "decoupling" of the spindle drive, the tool can now easily be removed from the packaging machine. It would be imaginable that, simultaneously with the decoupling of the spindle drive, also supply lines, such as power lines or compressed-air lines, between the tool and the other parts of the packaging machine are separated.

According to an advantageous embodiment, the second lift drive is coupled to the tool guide via a lever mechanism. This lever mechanism is robust and it has an uncomplicated structural design. In addition, it can ensure a precise movement of the tool guide in the vertical direction.

In addition, the lever mechanism offers the possibility of coupling the tool guide to the movement of the second lift drive with a certain gear ratio. This gear ratio is preferably a ratio in the range of from 1:2 to 1:10, even more advantageously a ratio in the range of from 1:3 to 1:5. In particular, the ratio could be 1:4. Due to the gear ratio the comparatively small amplitude of the movement of the second lift drive (e.g., 5 or 10 mm) is converted into a lifting or lowering movement of the tool guide which is enlarged by said gear ratio.

According to another variant of the present disclosure, it is imaginable that the lever mechanism is coupled to the tool guide via a spring. Such a spring can be used as a compensating extension element. In particular it can be used for cushioning the tool guide when the tool is being put down, so as to prevent an overdefinition of the system. In addition, the spring can serve as a tension spring so as to move the new tool upwards for reengaging the spindle with the spindle nut.

A particularly expedient embodiment is so conceived that the tool has provided thereon at least one roller for movement in rolling contact with the tool guide. This roller ensures that the friction caused between the tool and the tool guide will only be rolling friction but no sliding friction. The tool can thus be moved out of the packaging machine along the tool guide more easily. It goes without saying that, vice versa, it is also imaginable that the tool guide is provided with a plurality of rollers on which the tool can roll.

The tool guide is preferably provided with a roller arresting means for temporarily impeding a movement of the tool relative to the tool guide, i.e., this roller arresting means can be used for arresting the tool at its position on the tool guide until the arresting engagement is released, e.g., by exceeding a specific force threshold. The roller arresting means may e.g., be a recess along the tool guide, in which a roller can occupy a position of rest.

According to another advantageous embodiment, the tool guide is provided with at least one stop for limiting a movement of the tool relative to the tool guide. This stop can either prevent the tool from dropping out of the tool guide, or it can define a position which is particularly suitable for placing the tool into the machine, or for bringing the spindle of the spindle drive into engagement with the spindle nut.

In addition, the packaging machine is preferably provided with at least one sensor for detecting a position of the tool, of a drawer of the packaging machine and/or of a machine door of the packaging machine or for detecting engagement between the spindle and the spindle nut. Sensors on other components of the packaging machine are imaginable as well. They guarantee that specific operating steps, in particular operating steps during an exchange of tools, can only be executed when suitable safety measures have been taken. It is thus possible to prevent danger to the operator or damage to the packaging machine that may be caused by an exchange of tools.

The tool guide may e.g., be a tool guide strip, or the tool guide may comprise such a tool guide strip. It is also imaginable that a tool guide strip is provided on both sides of the tool.

In the following, an advantageous embodiment of the packaging machine according to the present disclosure will be explained in more detail with reference to the below drawings.

DETAILED DESCRIPTION

Figure 1:
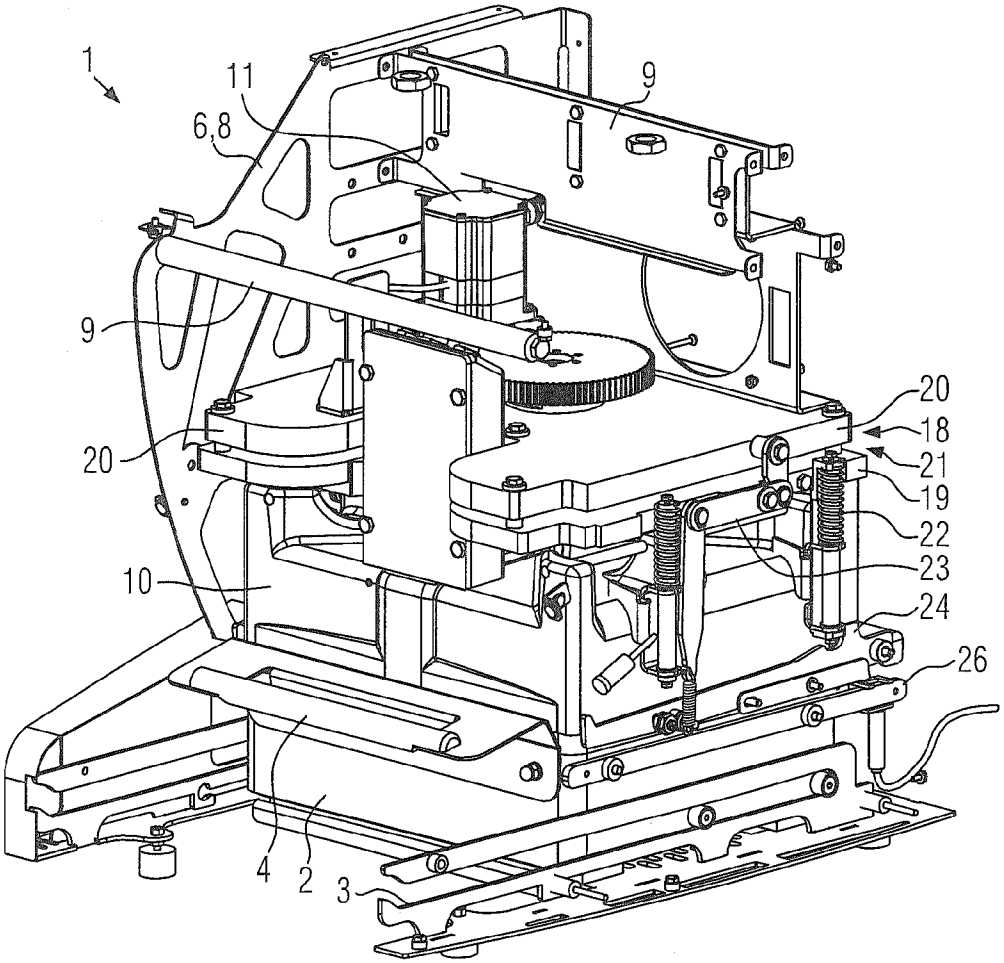
FIG. 1 is a perspective view of the functional components of a packaging machine according to the present disclosure.

Identical components are designated by identical reference numerals throughout the figures.

FIG. 1 shows a perspective view of a packaging machine 1 according to the present disclosure. In order to make the disclosure more easily understandable, the outer cover of the packaging machine 1 is not shown. The structural design and the mode of operation of the packaging machine 1 correspond largely to the packaging machine described in DE 10 2008 032 306 A1. The disclosure of this document is therefore fully incorporated by reference.

The packaging machine 1 is provided with a drawer 2. The drawer 2 is horizontally movable along a rail guide 3. A handle 4 is provided on the front of the drawer 2 so that said drawer 2 can be handled more easily.

Figure 4:
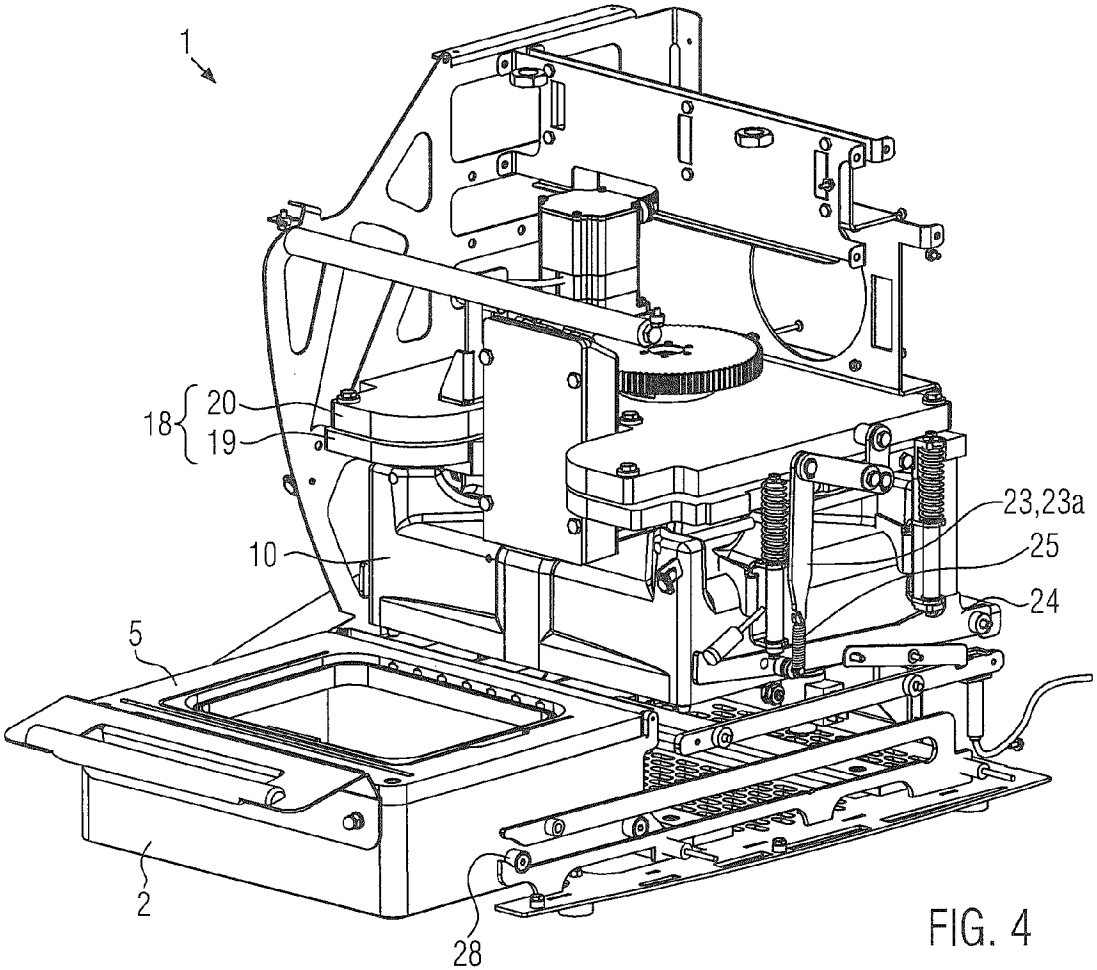
FIG. 4 is a perspective view of the packaging machine during a first tool exchange step.

The drawer 2 has provided therein a tray support 5 (cf. FIG. 4). The tray support 5 defines an opening into which tray-type containers can be inserted for being closed and sealed by means of the packaging machine 1.

The packaging machine 1 is provided with a stable frame 6. This frame 6 has two lateral frame panels 7, 8 as well as a plurality of struts 9 between these two lateral frame panels 7, 8. Within the frame 6 a tool 10 is provided, which is movable in the vertical direction in the frame 6. The tool 10 can serve to seal and/or cut films/foils of the packaging containers. The tool 10 is arranged such that it is disposed vertically above the drawer 2 at the pushed-in position of the drawer 2 shown in FIG. 1.

A first lift drive for vertically moving the tool 10 is implemented as a spindle drive 11. This spindle drive 11 can be seen in more detail in FIGS. 5 and 6. It comprises an electric motor 12, e.g., a servomotor, by means of which a gear 13 can be driven for rotation about a vertical axis. A spindle nut 14 is fixedly connected to the gear 13, i.e. the spindle nut 14 participates in the rotation of the gear 13. During normal operation of the packaging machine 1, a female thread 15 of the spindle nut 14 is in engagement with a male thread 16 of a spindle 17. Due to the rotation of the spindle nut 14 and the engagement of the two threads 15, 16, a vertical movement of the spindle 17 connected to the tool 10 is caused. This vertical movement allows the tool 10 to cover a comparatively long distance.

The packaging machine 1 is additionally provided with a second lift drive 18, which is also adapted to be used for causing a lifting or lowering movement of the tool 10. This second lifting or (preferably) lowering movement only takes place over a very small distance (e.g., 5 mm), but with very strong forces that are used for applying sealing or cutting forces to the tray-type containers. The second lift drive is provided with an intermediate plate 19, which is fixedly connected to the frame 6 of the packaging machine 1. Above the intermediate plate 19, a pressure plate 20 is provided, which is movable relative to said intermediate plate 19 and the frame 6. An evacuable space or a so-called vacuum membrane 21 is provided between the intermediate plate 19 and the pressure plate 20. When this vacuum membrane 21 is evacuated, the resultant vacuum has the effect that the pressure plate 20 is drawn towards the intermediate plate 19 against the forces exerted by pressure springs 22. The first drive 11 is supported by the pressure plate 20. It therefore participates in the lifting or lowering movement of the pressure plate 20—so does the tool 10 which is connected to the first drive 11 via the spindle 17.

A lever mechanism 23 is provided laterally next to the intermediate plate 19. This lever mechanism 23 comprises three lever arms which are articulated on one another. The uppermost of the three lever arms is articulated on the pressure plate 20. The opposite lower lever arm of the lever mechanism 23 is coupled to a tool guide 24, which is configured as a tool guide strip in the present case. The lever mechanism 23 and the tool guide 24 are coupled via a tension spring 25 (cf. FIGS. 4 and 17) in the present embodiment. Direct coupling of the lever mechanism 23 and of the tool guide 24 would, however, be imaginable as well. By means of the lever mechanism 23, a vertical movement of the pressure plate 20 is transmitted with a gear ratio of 1:4 to a vertical movement of the tool guide 24 in the opposite direction, i.e. a lowering of the pressure plate 20 has the effect that the tool guide 24 is lifted by a distance that is four times as large, and vice versa.

Below the tool guide 24 a magnetic strip 26 is provided. When the packaging machine 1 is in operation, this magnetic strip serves to convey the top film, which is used for sealing, into the packaging machine 1 by pushing in the drawer.

Figure 2:
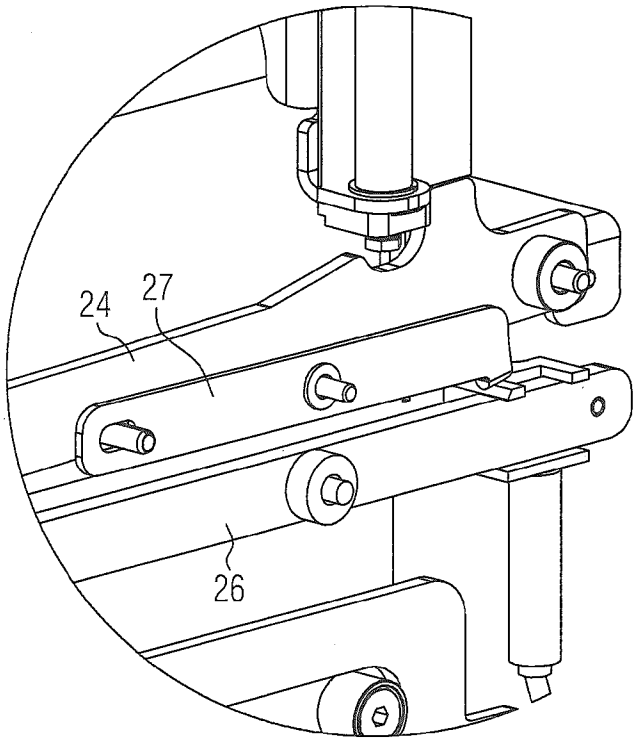
FIG. 2 is a detail of FIG. 1 at a first operating position.

FIG. 2 shows the rear end of the magnetic strip 26 at the normal operating position. Above the magnetic strip 26 a locking element 27 is provided. At the normal operating position, the locking means are unlocked.

Figure 3:
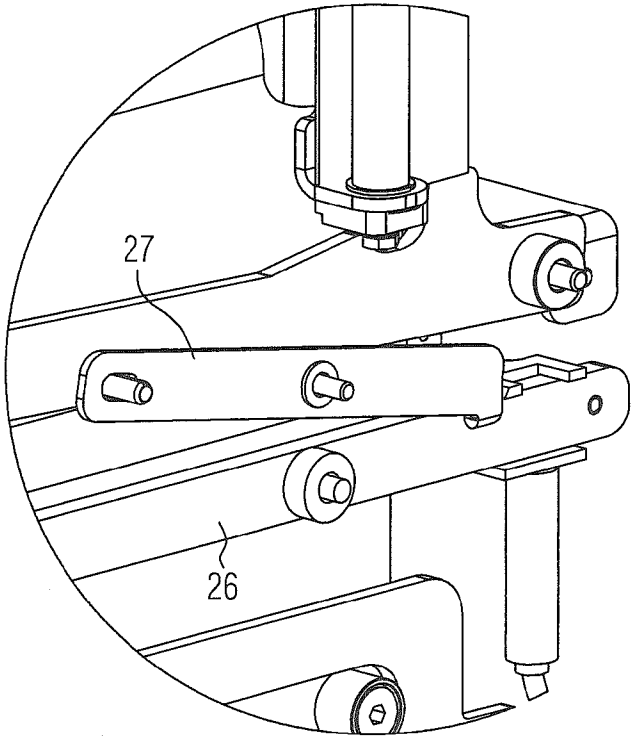
FIG. 3 is the same detail as FIG. 2 at a locked operating position.

FIG. 3 shows a condition after the lowering of the pressure plate 20, which has the effect that the lever mechanism 23 is operated. The lever mechanism 23 pivots the locking element 27 coupled thereto so that the latter is brought into engagement with the magnetic strip 26. FIG. 3 shows the locking element 27 at the locked position at which it prevents the magnetic strip 26 from being pulled forward out of the packaging machine 1 together with the drawer 2.

For initiating an exchange of the tool 10, the operator activates a respective tool exchange mode on a control panel. A first sensor detects whether the tool 10 is disposed at its upper position. A second sensor detects whether the drawer 2 occupies its pushed-in production position, and a third sensor detects whether the magnetic strip 26 occupies its rear position for drawing off the top film. A fourth sensor determines whether the machine door of the packaging machine 1 is closed. If one of these conditions should not be fulfilled, this will be displayed to the operator. Otherwise, the semi-automatic tool exchange starts. To this end, the vacuum membrane 21 of the second lift drive 18 is first evacuated. This has the effect that the pressure plate 20 is lowered onto the intermediate plate 19. FIG. 4 shows the packaging machine 1 in this condition.

The lowering of the pressure plate 20 also has the effect that the lever mechanism 23 is moved. This movement causes an upward movement of the lever arm 23*a*, which extends in an approximately vertical direction and which is the lever arm that is most remote from the pressure plate 20. During this upward movement, the lever arm 23*a* draws the tool guide strip 24 upwards via the tension spring 25, i.e. it causes the tool guide 24 to pivot correspondingly upwards. At the same time, the lever mechanism 23 also draws the locking element 27 upwards so that the latter will lock the magnetic strip 26—as shown in FIG. 3—so that said magnetic strip 26 will not be able to participate in the subsequent movement of the drawer 2. The operator now moves the drawer 2 manually from its rear production position to the front exchange position shown in FIG. 4. This is done in that rollers 28 provided on the drawer 2 slide in the horizontal rail guide 3. A sensor detects whether the drawer 2 has been advanced far enough to not impede the movement of the tool 10 during the continued tool exchange operation. The signal of the sensor is also used for eliminating the locked condition of the magnetic strip 26 by means of the locking element 27. When the drawer 2 has been pushed in again, the magnetic strip 26 can thus be recoupled to the drawer so that, when the drawer 2 is pushed in once more, the magnetic strip 26 will be able to clamp the top film and carry it along into the packaging machine 1.

Figure 5:
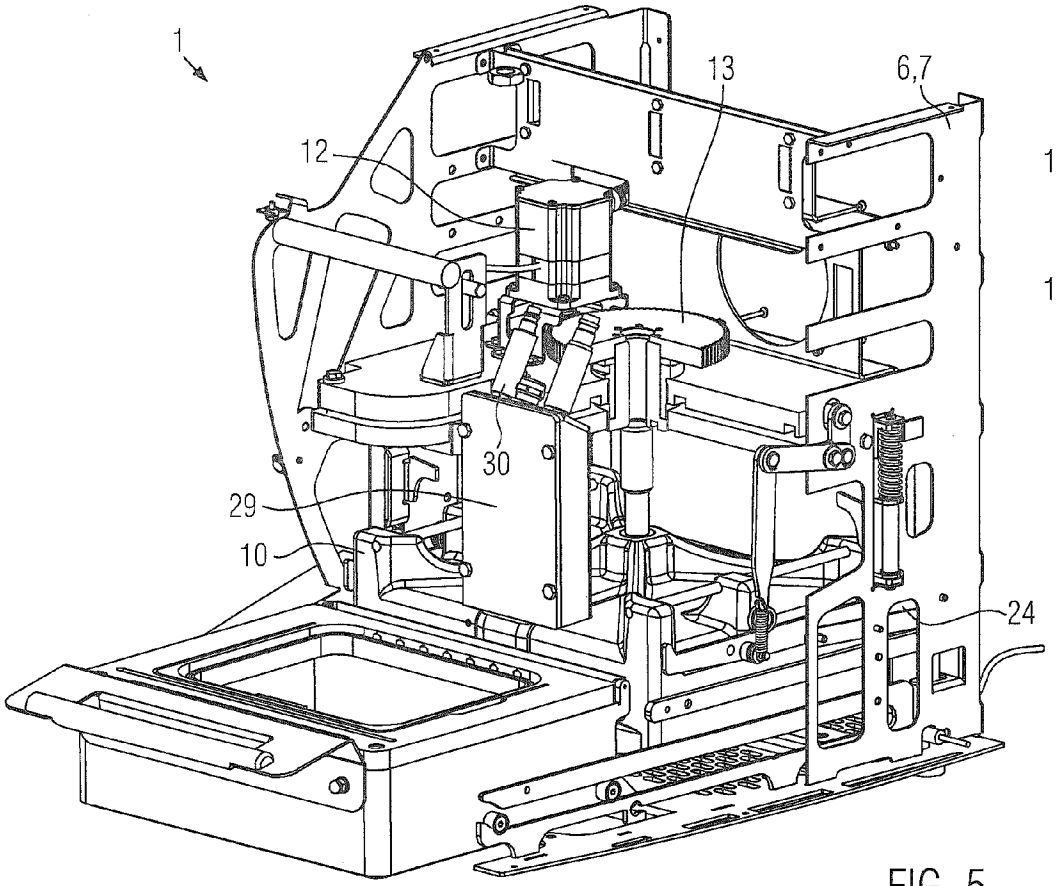
FIG. 5 is a perspective view of the packaging machine during a second tool exchange step.

In the representation shown in FIG. 5, parts of the intermediate plate 19 and of the pressure plate 20 of the second lift drive 18 have been removed so that the components of the first drive, i.e. of the spindle drive 11, can be seen more clearly. This spindle drive 11 is now actuated in that the electric motor 12 rotates the gear 13 and the spindle nut 14 connected thereto, so as to lower the spindle 17. This leads to a lowering of the tool 10.

Figure 6:
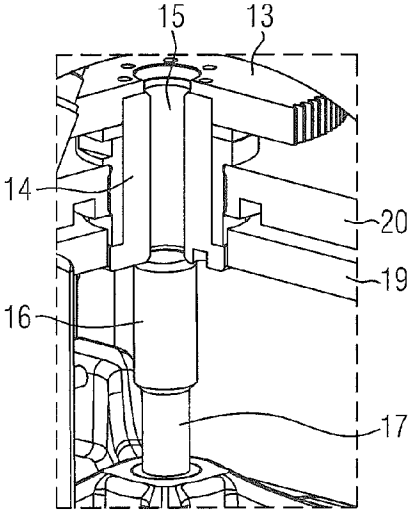
FIG. 6 is an enlarged detail of FIG. 5.

FIG. 6 shows an enlarged view of the spindle nut 14 and of the spindle 17 at the moment at which the spindle 17 disengages from the spindle nut 14, i.e. at the moment at which the threads 15, 16 come out of engagement. The upper position which the tool guide 24 occupies in FIG. 5 is chosen such that the tool 10 will be put down on the tool guide 24 as immediately as possible after decoupling of the spindle drive 11—as will be explained in more detail hereinbelow with reference to FIG. 7. FIG. 5 additionally shows a distribution block 29 which is disposed on the tool 10. On the upper surface of the distribution block 29, connection pieces 30 are provided for supply lines, e.g., for current or for a vacuum. During normal operation, these connection pieces 30 are coupled with suitable firm counter pieces on the packaging machine 1 so as to supply current and/or a vacuum to the tool. When the tool 10 is being lowered, the connection pieces 30 come automatically out of engagement with their counter pieces, or this separation is carried out by hand after the lowering.

Figure 7:
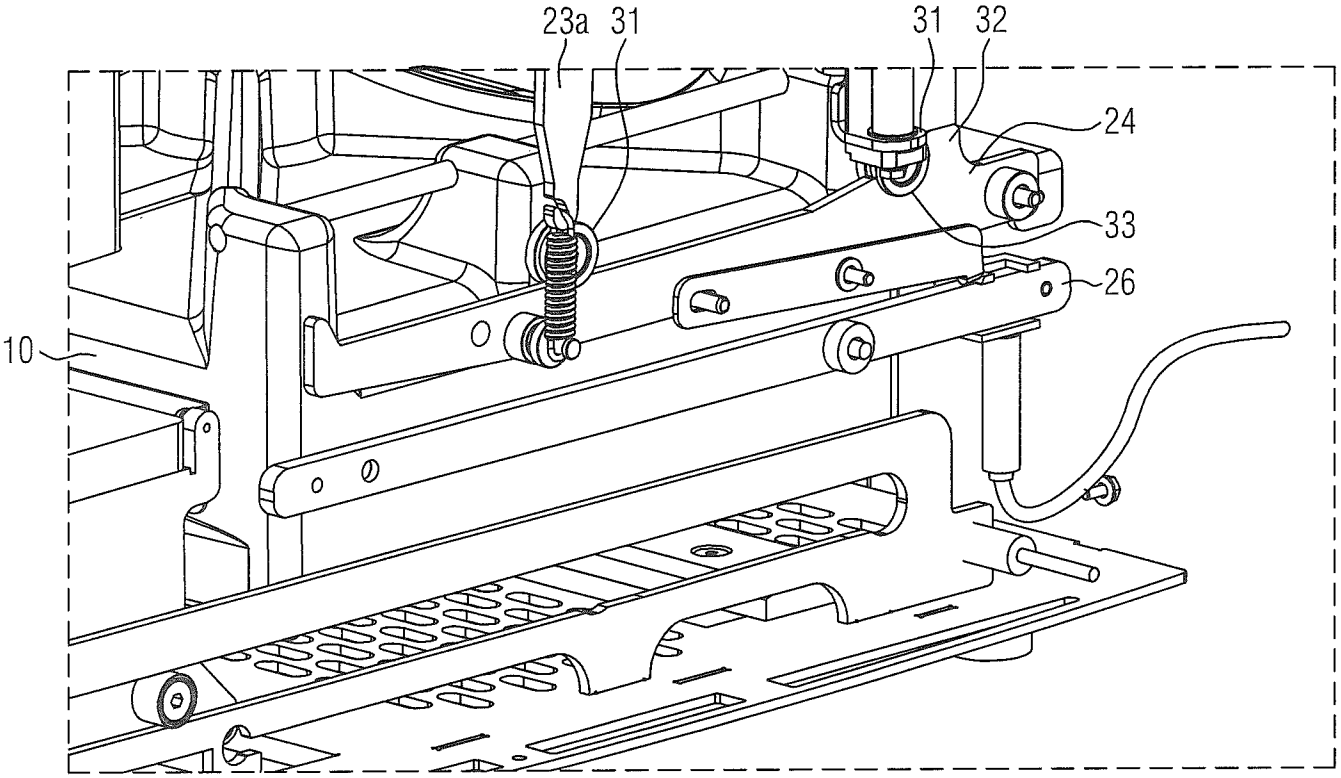
FIG. 7 is an enlarged representation of the tool guide of the packaging machine.

As can be seen in FIG. 7 more clearly, rollers 31 are provided laterally on the tool. These rollers 31 project laterally beyond the tool 10 just far enough to allow them to be placed onto the upper surface of the tool guide 24. This placing onto the tool guide 24 is preferably carried out immediately after the decoupling of the first spindle drive 11. FIG. 7 shows the tool 10 that has been placed onto the tool guide 24 in this way.

At the rear end of the tool guide 24, i.e. at the right end of the tool guide 24 in FIG. 7, a rear stop 32 is provided. It limits the movement of the rollers 31 on the tool guide 24 and prevents the tool 10 thus from moving to a position beyond the position defined by the rear stop 32. Directly before the rear stop 32, a roller arresting means 33 is provided. In the present case, said roller arresting means 33 is a recess in the tool guide 24, in which the rear roller 31 comes to lie when the tool 10 is being lowered. The roller arresting means 33 thus defines a position of rest of the tool 10, which said tool 10 can only leave in response to an application of sufficiently high tensile forces. At the front end of the tool guide 24 a front stop 34 is provided. It limits the forward movement of the front roller 31 and, consequently, of the whole tool 10. The tool guide 24 is stable enough and, via the tension spring 25 connected to the lever mechanism 23, it is also supported in a sufficiently stable manner for taking up the whole weight of the movable tool 10.

Figure 8:
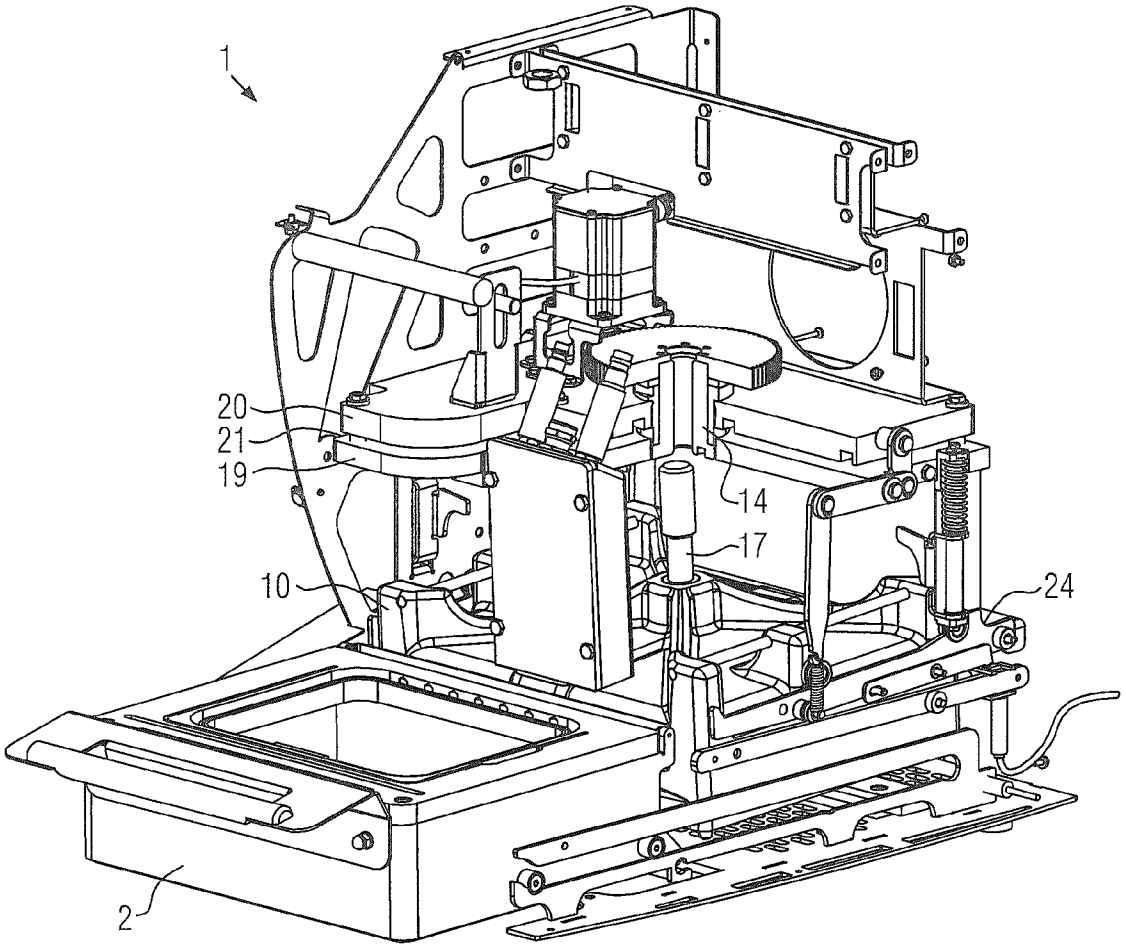
FIG. 8 is a perspective view of the packaging machine during a further tool exchange step.

Subsequently, the vacuum membrane 21 is aerated, whereby the pressure plate 20 rises again. This condition of the packaging machine 1 is shown in FIG. 8. The rising of the pressure plate 20 has the effect that the spindle 17 is now completely pulled out of the spindle nut 14. The rising of the pressure plate 20 simultaneously actuates the lever mechanism 23 thus causing the tool guide 24 to be lowered. The tool 10, which rests on the tool guide 24 with its rollers 31, participates in the downward movement of the tool guide 24. As can be seen in FIG. 8, the tool 10 is now located behind the drawer 2 and approximately on the same level as said drawer 2.

Figure 9:
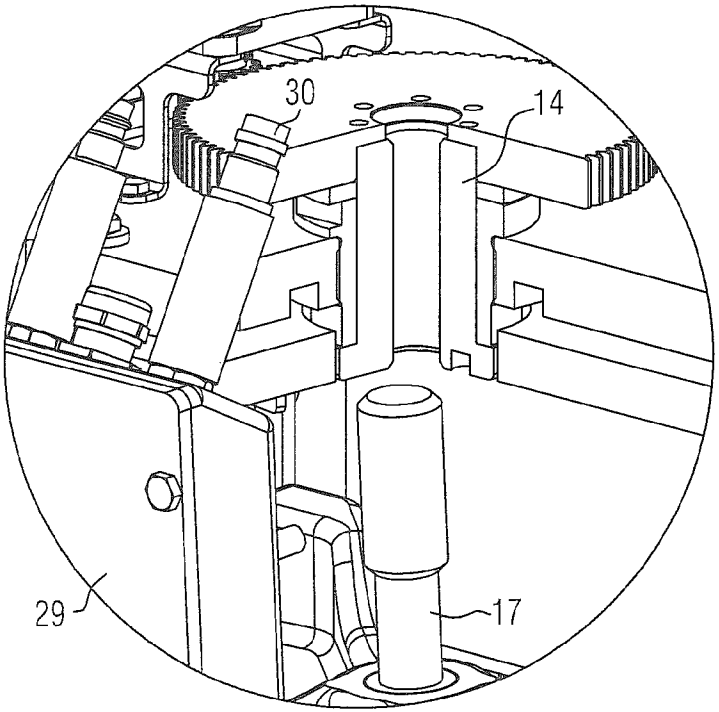
FIG. 9 is the enlargement of a detail of FIG. 8.

FIG. 9 shows the condition of the first spindle drive 11 in FIG. 8 in an enlarged view. It is here clearly visible that the spindle 17 has been pulled out of the spindle nut 14, and that in particular the upper end of the spindle 17 is disposed below the lower end of the spindle nut 14. This allows the tool 10 to be removed forwards from the packaging machine 1 later on.

Figure 10:
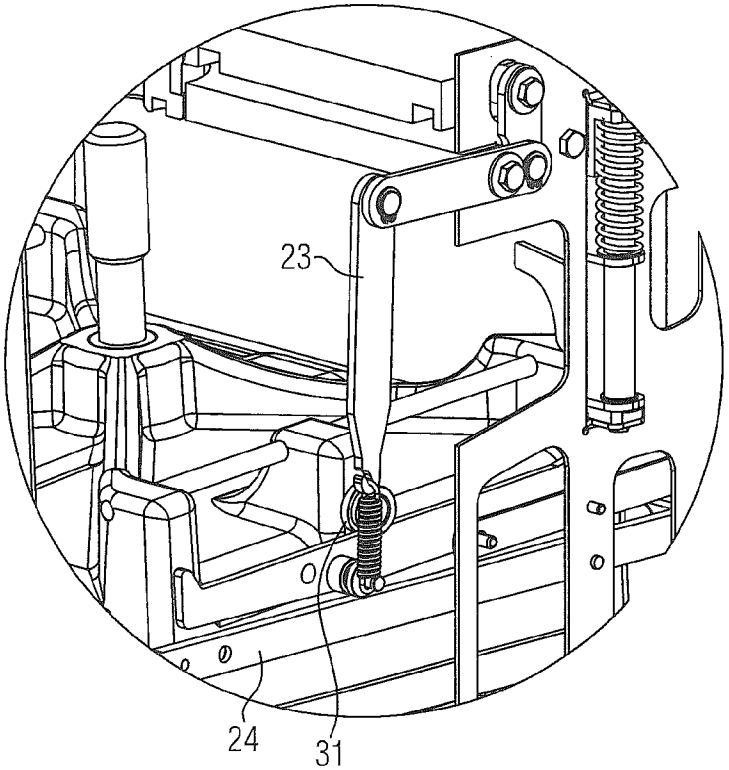
FIG. 10 is the enlargement of a further detail of FIG. 8.

FIG. 10 shows the lever mechanism 23 in the condition according to FIG. 8. In this condition, the lever mechanism 23 has fully lowered the tool guide 24.

Figure 11:
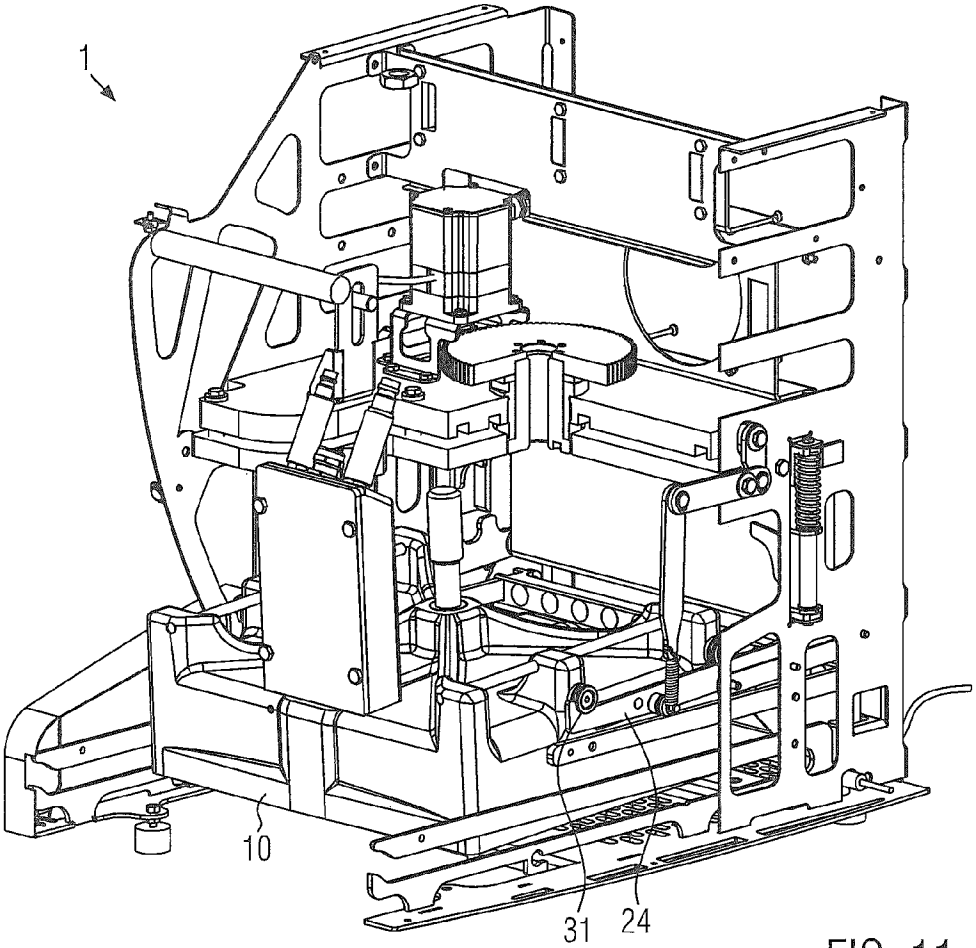
FIG. 11 is a perspective view of the packaging machine during a further tool exchange step.
Figure 12:
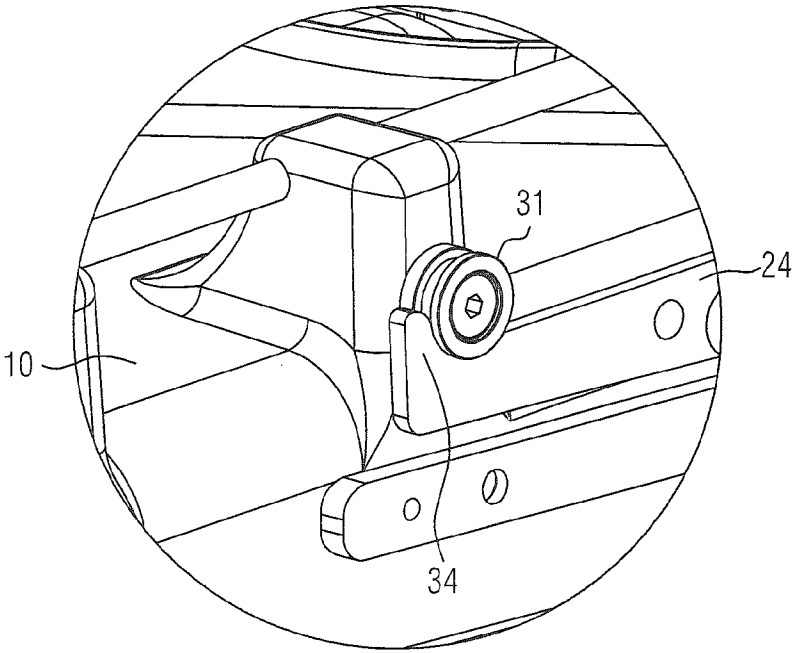
FIG. 12 is the enlargement of a detail of FIG. 11.

The next tool exchange step is shown in FIG. 11. There, the drawer 2 has been removed from the packaging machine 1 by the operator. Subsequently, the tool 10 is pulled forward by the operator. During this movement, the rollers 31 of the tool 10 move on the tool guide 24 until the front roller 31 strikes against the front stop 34. The front stop 34 thus prevents the possibly heavy tool 10 from inadvertently dropping forwards out of the packaging machine 1. The contact between the front roller 31 of the tool 10 with the front stop 34 of the tool guide 24 can be seen in FIG. 12 in an enlarged view.

Figure 13:
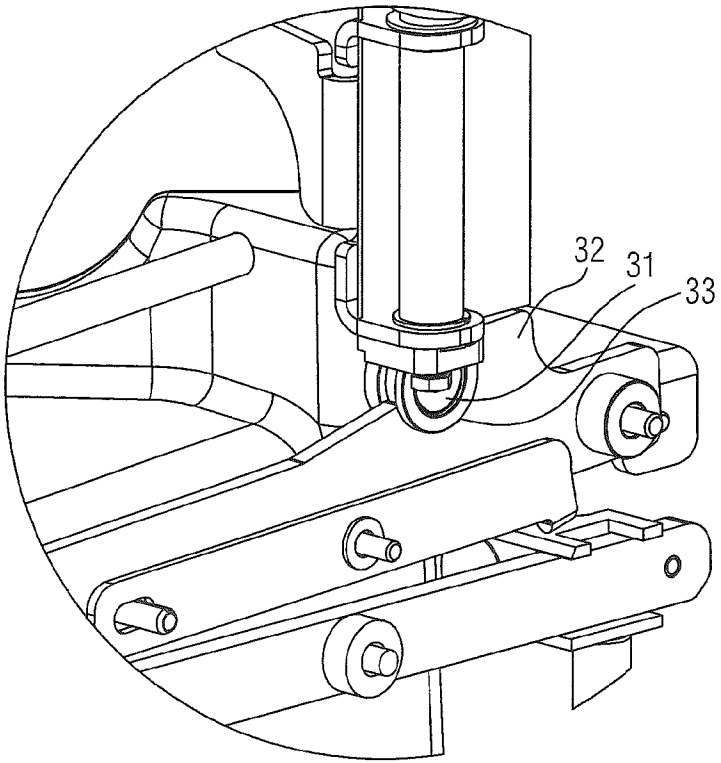
FIG. 13 is the enlargement of a further detail of FIG. 11.

Through the machine door of the packaging machine 1, which is provided above the drawer 2 and which has been opened in the meantime, the operator can now remove the tool 10 to be exchanged from the packaging machine 1. To this end, he lifts the rollers 31 from the tool guide 24. Subsequently, the operator places the rollers 31 of a new tool 10, which may provide a different format for the packages to be produced, onto the tool guide 24. The outer dimensions of the tools 10 are, for this purpose, as identical as possible. Subsequently, the operator pushes the tool 10 into the packaging machine 1. During this movement, the rollers 31 roll on the tool guide 24 until—as shown in FIG. 13—the rear roller 31 strikes against the rear stop 32 and comes to lie in the roller arresting means 33. The dropping of the roller 31 gives the operator a tactile feedback that the tool 10 has now assumed the defined, rear position. A sensor detects the absence of the drawer 2, whereas another sensor detects the open condition of the machine door.

Figure 14:
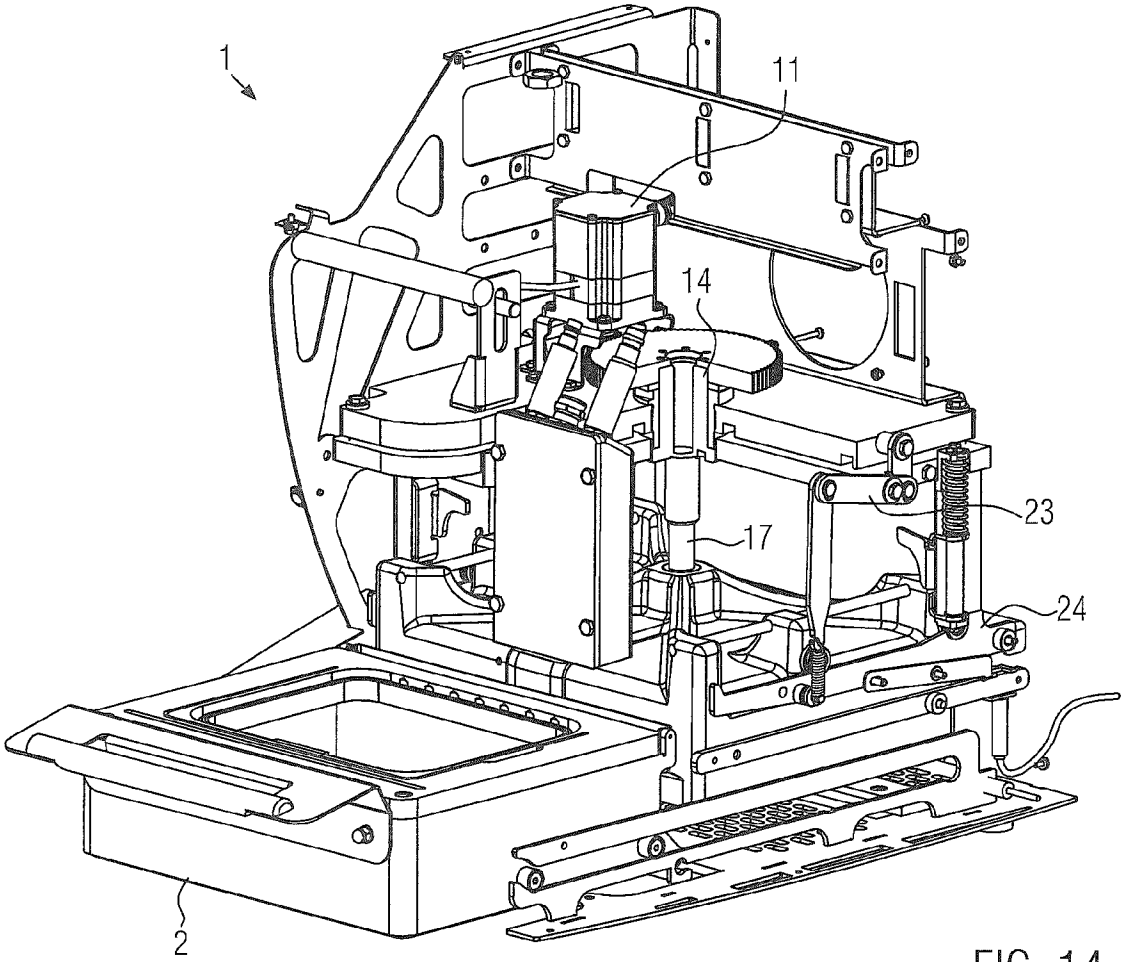
FIG. 14 is a perspective view of the packaging machine during a further tool exchange step.

The next tool exchange step is shown in FIG. 14. The drawer 2 has been reinserted into the rail guide 3. The membrane 21 of the second lift drive 18 is evacuated so as to lift, by means of the lever mechanism 23, the tool guide strip 24 together with the tool 10. Due to the fact that this tool 10 is fixed in position by the roller arresting means 33, it is guaranteed that the spindle 17 of the tool will be in direct alignment with the spindle nut 14 of the first spindle drive 11 during such lifting. If early contact between the spindle nut 14 and the spindle 17 should occur, the tension spring 25 will ensure a compensating extension of the lever mechanism 23. The electric motor 12 causes slow rotation of the spindle nut 14, so that the female thread 15 of the latter can receive therein the male thread 16 of the spindle 17 as soon as the two threads 15, 16 come into engagement with one another.

Figure 15:
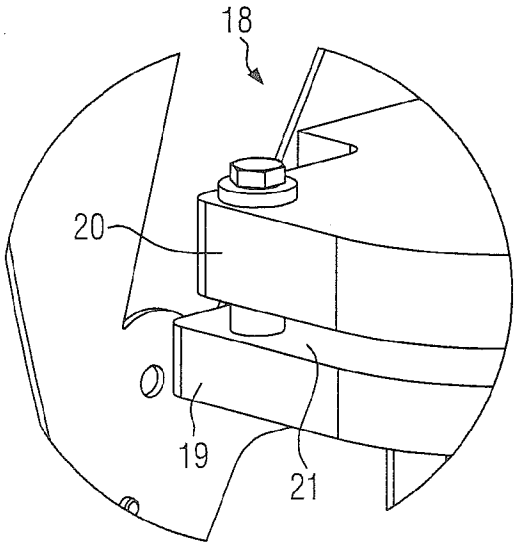

FIG. 15 shows an enlarged representation of the second lift drive 18 in a condition in which the vacuum membrane 21 has been evacuated. In this case, the fixed intermediate plate 19 and the pressure plate 20 are spaced apart at a vertical distance of only approximately 3 mm. When the vacuum membrane 21 has been aerated, the vertical distance between the two plates 19, 20 has enlarged to approximately 8 mm.

Figure 16:
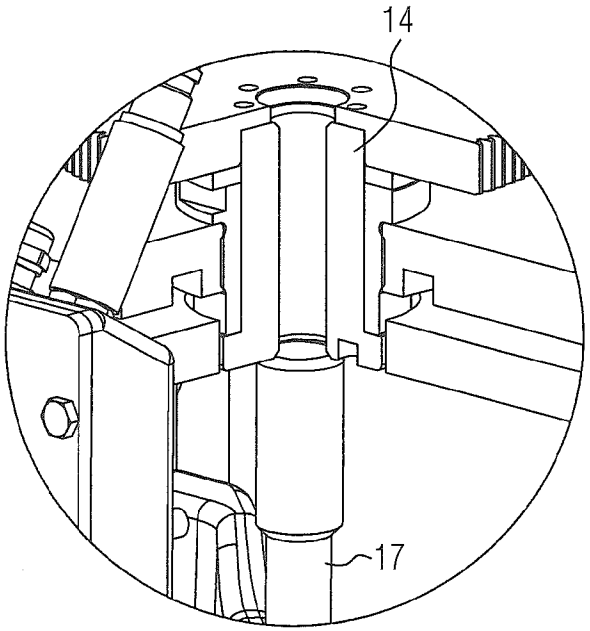

FIG. 16 shows the condition of the first spindle drive 11 when the spindle 17 is threaded into the spindle nut 14. Here, it can be seen that the spindle 17 is in alignment with the spindle nut 14. The spindle nut 14 has been lowered by means of the second lift drive 18 so as to come into engagement with the upper end of the spindle 17.

Figure 17:
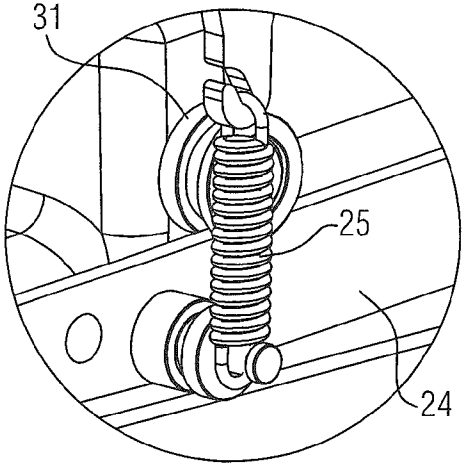
FIGS. 15 to 17 are enlarged details of FIG. 14.

FIG. 17 shows an enlarged representation of the tension spring 25, which is used as a safety expansion spring and which couples the lower end of the lever mechanism 23 to the tool guide strip 24.

Figure 18:
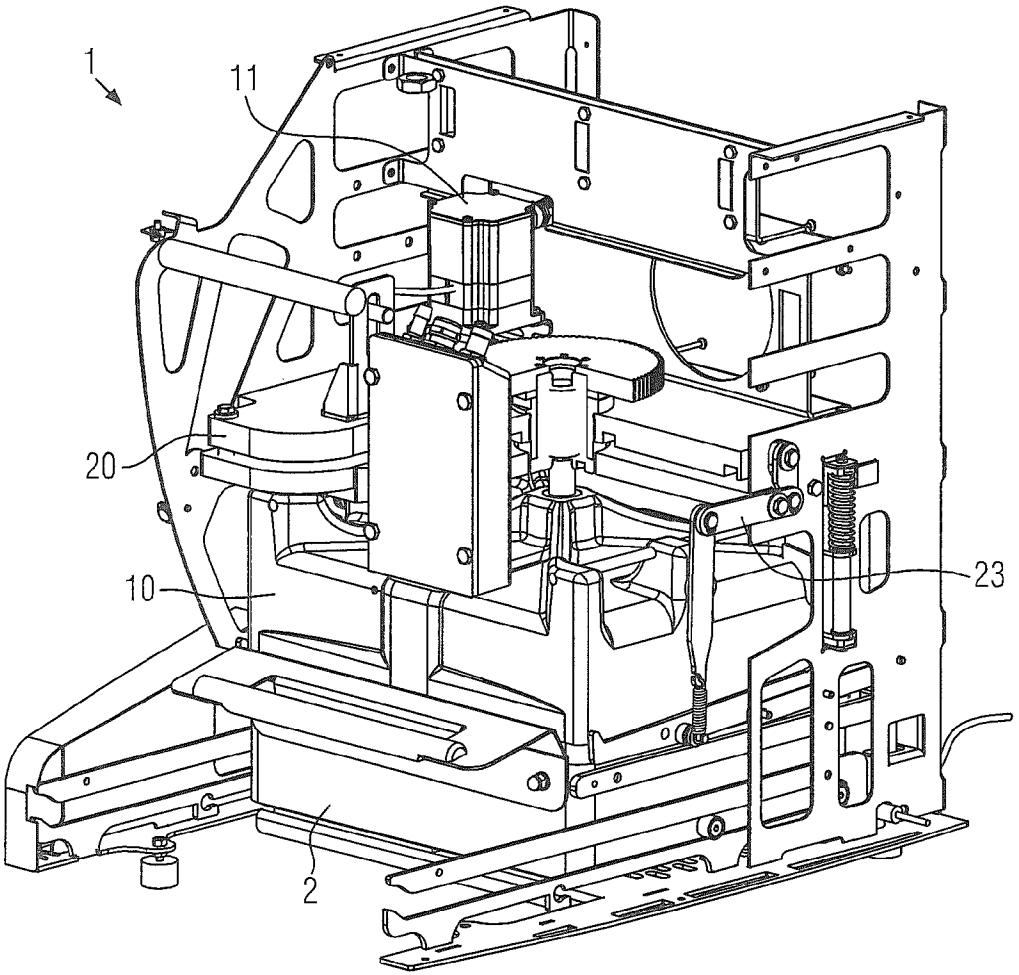
FIG. 18 is a perspective view of the packaging machine after termination of the tool.

FIG. 18 shows the packaging machine 1 during a last tool exchange step. The first spindle drive 11 is now again coupled, i.e., the spindle 17 is again in engagement with the spindle nut 14. The first spindle drive 11 thus pulls the tool 10 upwards. In the second lift drive 18, however, the vacuum membrane 21 has been aerated so as to lift the pressure plate 20. This has the effect that the lever mechanism 23 is extended so that the tool guide strip 24 is lowered or tilted downwards. At the same time, the locking element 27 is returned to its starting position so as to eliminate the locking of the magnetic strip 26. A sensor detects that the tool 10 is again at its upper operating position. The drawer 2 is pushed backwards by the operator. Also the pushed-in position of the drawer 2 is detected by means of a sensor. Tool exchange is now finished and the packaging machine 1 can be operated with the new tool 10.

The packaging machine 1 according to the present disclosure allows a semi-automatic exchange of the tool 10, which, in comparison with conventional tool exchange mechanisms in the case of this type of packaging machines, is much more convenient for the operator. Suitable sensors monitor the positions of the various components in the packaging machine 1 in the case of the various tool exchange steps. Thus, they guarantee a smooth sequence of tool exchange steps, and they guarantee the safety of the operator, since certain steps can only be executed if suitable conditions prevail. In addition, the sensors support a further automation of the tool exchange operation. For example, the lifting of a new tool 10 may take place automatically as soon as it has been detected by suitable sensors that the rear roller 31 of the new tool 10 is disposed in the roller arresting means 33.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A packaging machine comprising:

a tool comprising an upper tool part and a lower tool part, said upper tool part comprising a plurality of support members that project laterally from said upper tool part;

a first lift drive removably coupled with said upper tool part, the first lift drive for raising and lowering the upper tool part between a first raised position and a first lowered position along a path of movement;

a second lift drive removably engaged with the upper tool part for raising and lowering the upper tool part between a second raised position and a second lowered position along the path of movement, said first lift drive and said second lift drive being disposed for independent operation;

at least one tool guide disposed outside of the path of movement of the upper tool part, and said at least one tool guide being operably connected to said second lift drive and moveable by said second lift drive between an up position and a down position, wherein lowering said upper tool part to said second lowered position by said second lift drive simultaneously raises said tool guide to said up position; and wherein said support members of said upper tool part engage said tool guide when said tool guide is in said up position and said upper tool part is in said first lowered position.

2. The packaging machine of claim 1 wherein said tool guide has a length and said support members of said upper tool part each comprise a roller, wherein said roller is disposed to roll along said length of said tool guide when said upper tool part is uncoupled from said first lift drive and unengaged with said second lift drive.

3. The packaging machine of claim 1 wherein each of said at least one tool guide is operably connected to said second lift drive by a lever mechanism, wherein a first end of the lever mechanism is pivotally coupled to the second lift drive and a second end of said lever mechanism is pivotally coupled to the at least one tool guide.

4. The packaging machine according to claim 3, wherein the lever mechanism has a gear ratio in the range of from 1:2 to 1:10 and wherein the lever mechanism is coupled to the respective tool guide via a spring.

5. The packaging machine of claim 1 wherein said lower tool part is disposed in an opposing relationship with said upper tool part in the path of movement of the upper tool part when said packaging machine is in an operating mode, and said lower tool part is laterally offset from the path of movement of the upper tool part when said packaging machine is in a tool exchange mode.

6. The packaging machine of claim 5 wherein said tool guide has a length and said support members of said upper tool part each comprise a roller, and wherein said roller is disposed to roll along said length of said tool guide when said packaging machine is in said tool exchange mode and said upper tool part is both uncoupled from said first lift drive and unengaged with said second lift drive.

7. The packaging machine of claim 1 wherein said second lift drive comprises a moveable plate, said first lift drive mounted on said moveable plate so that movement of said moveable plate raises and lowers both the first lift drive and the upper tool part between said second raised position and said second lowered position, and wherein said at least one tool guide is operably connected to said moveable plate.

* * * * *